US006939170B2

(12) United States Patent
Torii

(10) Patent No.: US 6,939,170 B2
(45) Date of Patent: Sep. 6, 2005

(54) CONNECTOR

(75) Inventor: Chieko Torii, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/770,565

(22) Filed: Feb. 4, 2004

(65) Prior Publication Data

US 2004/0157501 A1 Aug. 12, 2004

(30) Foreign Application Priority Data

Feb. 7, 2003 (JP) ..... P2003-031647

(51) Int. Cl.[7] ..... H01R 13/40
(52) U.S. Cl. ..... 439/595
(58) Field of Search ..... 439/595, 752

(56) References Cited

U.S. PATENT DOCUMENTS 4,557,542 A 12/1985 Coller et al.
4,998,896 A * 3/1991 Lundergan ..... 439/595
5,503,569 A * 4/1996 Huss et al. ..... 439/595
5,931,707 A 8/1999 Ito
6,077,117 A * 6/2000 Iwahori ..... 439/595

FOREIGN PATENT DOCUMENTS

JP 2002-343499 A 11/2002

* cited by examiner

*Primary Examiner*—Phuong Dinh
(74) *Attorney, Agent, or Firm*—Sughrue Mion, PLLC

(57) ABSTRACT

A tubular connector housing is adapted to receive a terminal fitting coupled with an electric wire. An inner holder is accommodated in the connector housing so as to place the terminal fitting therein. The inner holder is slidable between a first position which allows the terminal fitting to be withdrawn from the connector housing and a second position which prevents the terminal fitting from being withdrawn from the connector housing. A through hole is formed in a side wall of the connector housing such that a part of an outer side face of the inner holder is actuated therethrough, in order to displace the inner holder between the first position and the second position.

5 Claims, 9 Drawing Sheets

CONNECTOR

BACKGROUND OF THE INVENTION

This invention relates to a connector used for connecting wires or the like.

Various electronic equipments are mounted on a vehicle. Wire harnesses for transmitting electric power, control signals and others to the electric equipments are installed on the vehicle. The wire harness comprises a plurality of wires, and connectors. The wire is a so-called sheathed wire comprising an conductive core wire (conductor) and an insulating sheath covering this conductor.

Related-art connectors 101, shown respectively in FIGS. 9A through 11B, are used as such a connector. Each connector 101 comprises male terminal fittings (not shown and hereinafter referred to as "male terminals"), a connector housing 102, and an inner holder 103.

The male terminal is formed of an conductive metal sheet or the like, and includes a wire coupling portion and an electrical contact portion. The above-mentioned wire is electrically and mechanically connected to the wire coupling portion. The electrical contact portion is formed into a plate-shape, and is continuous with the wire coupling portion. The electrical contact portion is inserted into an electrical contact portion of a female terminal fitting provided in a mating connector adapted to be fitted with the connector 101, and is electrically connected to the electrical contact portion of the female terminal fitting.

The connector housing 102 is made of an insulative synthetic resin, and is formed into a tubular shape. As shown in FIGS. 9B, 10B and 11B, the connector housing 102 has a plurality of terminal chambers 104 for respectively receiving the male terminals. The terminal chambers 104 are formed linearly, and are arranged parallel to one another. The male terminals are received respectively in the terminal chambers 104 in such a manner that the electrical contact portions of the male terminals face a first opening 102*a* of the connector housing 102 while the wire coupling portions of the male terminals face a second opening 102*b* of the connector housing 102.

The inner holder 103 is inserted into the connector housing 102 through the first opening 102*a*. The inner holder 103 is mounted in the connector housing 102 in such a manner that the inner holder 103 is retained on an inner face of the connector housing 102. The inner holder 103, thus mounted in the connector housing 102, is slidable between a provisional engagement position (shown in FIGS. 9A, 10A and 11A) and a plenary engagement position (shown in FIGS. 9B, 10B and 11B).

In the provisional engagement position, the inner holder 103 allows the male terminals to be inserted respectively into the terminal chambers 104 through second opening 102*b*, and also allows the male terminal to be withdrawn respectively from the terminal chambers 104 through second opening 102*b*. In the plenary engagement position, the inner holder 103 prevents the male terminals from being withdrawn respectively from the terminal chambers 104 through second opening 102*b*. In the plenary engagement position, the electrical contact portions of the male terminals project from the inner holder 103 toward the first opening 102*a*.

A hooked portion 106 is formed in the inner holder 103. The jig 105 is inserted into the connector housing 102 through the first opening 102*a*, and a distal end portion 105*a* of the jig 105 is hooked over the hooked portion 106 so that the inner holder 103 can be moved between the provisional engagement position and the plenary engagement position by the jig 105.

In the above related-art connectors 101, particularly in the plenary engagement position, the electrical contact portions of the male terminals project from the inner holder 103 toward the first opening 102*a*. Therefore, particularly when the distal end portion 105*a* of the jig 105 is to be hooked over the hooked portion 106 so as to move the inner holder 103 from the plenary engagement position to the provisional engagement position, the distal end portion 105*a* is sometimes accidentally brought into contact with the electrical contact portion of the male terminal.

When the distal end portion 105*a* of the jig 105 is brought into contact with the electrical contact portion of the male terminal, the electrical contact portion of this male terminal is bent in some cases. There are occasions when the thus bent electrical contact portion of the male terminal cannot be connected to the female terminal in the mating connector. Further, when the distal end portion 105*a* of the jig 105 is brought into contact with the electrical contact portion of the male terminal, there is a probability that the electrical contact portion is bent, and is separated from the wire coupling portion, thus damaging the male terminal, in the worst case.

SUMMARY OF THE INVENTION

It is therefore an object of this invention to provide a connector having an inner holder received in a connector housing, in which terminal fittings can be positively connected respectively to mating terminal fittings, and these terminal fittings are prevented from damage.

In order to achieve the above object, according to the invention, there is provided a connector, comprising:

a tubular connector housing, adapted to receive a terminal fitting coupled with an electric wire; and an inner holder, accommodated in the connector housing so as to place the terminal fitting therein, the inner holder being between a first position which allows the terminal fitting to be withdrawn from the connector housing and a second position which prevents the terminal fitting from being withdrawn from the connector housing;

wherein a through hole is formed in a side wall of the connector housing such that a part of an outer side face of the inner holder is actuated therethrough, in order to displace the inner holder between the first position and the second position.

In such a configuration, by pushing the part of the outer face of the inner holder through the through hole, the inner holder can be moved between the first position and the second position while preventing an actuating member such as a jig from being brought into contact with the terminal fitting inadvertently. Therefore, the terminal fitting is prevented from being bent and damaged, so that the terminal fitting can be positively connected to the mating terminal fitting.

Preferably, an operated member, which is to be externally actuated in the sliding direction of the inner housing, is formed on the outer side face of the inner holder so as to be located within the through hole.

In such a configuration, the operated member can be positively operated. Therefore, the inner holder can be positively moved between the first position and the second position.

Here, it is preferable that the operated member is a projection extending outward through the through hole.

In such a configuration, the operated member can be further positively operated.

Here, it is further preferable that: a pair of protective walls are formed on the side wall of the connector housing at both sides of the through hole relative to a direction perpendicular to the sliding direction of the inner holder; and a top face of each of the protective walls is situated upper than a top face of the operated member.

In such a configuration, the protective walls will not prevent the movement of the operated member. Further, an external article or the like is prevented from being inadvertently brought into contact with the operated member, and therefore is prevented from pushing the operated member in the direction of movement of the inner holder.

Preferably, at least one pair of projections are formed on the outer face of the inner housing, and are arranged to be engaged with an inner face of the connector housing such that the inner holder is retained in either the first position or the second position while being allowed to be displaced between the first position and the second position. The pair of projections are juxtaposed in a direction orthogonal to the sliding direction of the inner holder.

In such a configuration, a mold for molding the inner holder can be formed into a simple structure to reduce the manufacturing cost.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1:
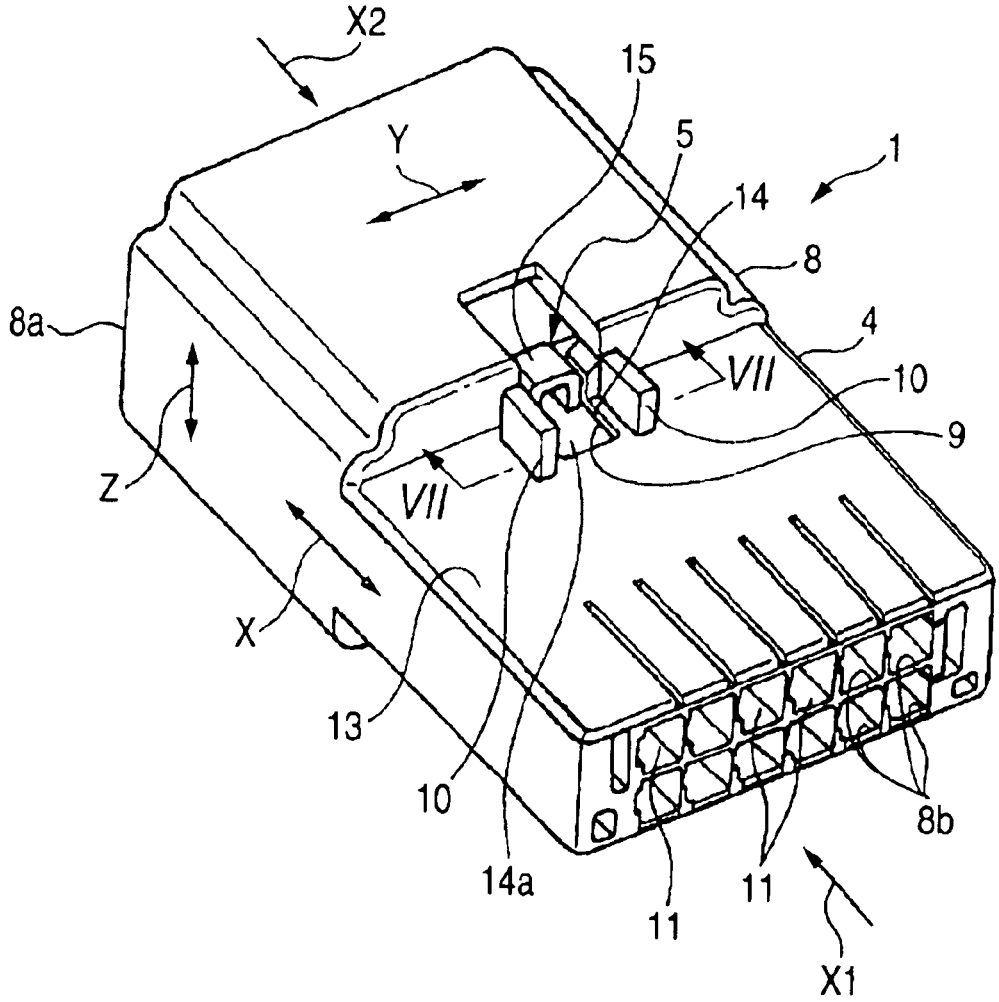
FIG. 1 is a perspective view showing a connector according to one embodiment of the invention.

One preferred embodiment of the invention will be described below in detail with reference to the accompanying drawings. A connector 1 of the embodiment is used to form a wire harness for installation on a vehicle or the like. The wire harness comprises a plurality of wires 2 (shown in FIGS. 5 and 6), and the connector 1. The wire 2 comprises an conductive core wire (conductor), and an insulating sheath covering this conductor.

The connector 1 comprises male terminal fittings 3, a connector housing 4, and an inner holder 5.

The male terminal 3 is formed of an conductive metal sheet or the like, and includes a wire coupling portion 6 and an electrical contact portion 7. The wire 2 is electrically and mechanically connected to the wire coupling portion 6. The electrical contact portion 7 is formed into a plate-shape, and is continuous with the wire coupling portion 6. The electrical contact portion 7 is inserted into an electrical contact portion of a female terminal fitting (hereinafter referred to as "female terminal") provided in a mating connector adapted to be fitted with the connector 1, and is electrically connected to the electrical contact portion of the female terminal fitting.

The connector housing 4 is made of an insulative synthetic resin, and is formed into a tubular shape. The connector housing includes a tubular main body 8, an operation hole 9, and a pair of protective walls 10. The main body 8 has a plurality of terminal chambers 11 for respectively receiving the male terminals 3. The terminal chambers 11 are formed linearly, and are arranged parallel to one another. A retaining pawl 12 is integrally formed on an inner face of each terminal chamber 11 so as to extend inwardly. The retaining pawl 12 is retainingly engaged with an edge of the electrical contact portion 7 of the male terminal 3 disposed close to the wire coupling portion 6.

The male terminals 3 are received respectively in the terminal chambers 11 in such a manner that the electrical contact portions 7 of the male terminals 3 face a first opening 8*a* of the main body 8 of the connector housing 4 while the wire coupling portions 6 of the male terminals face a second opening 8*b* of the main body 8 of the connector housing 4.

The male terminals 3 are inserted respectively into the terminal chambers 11 through the second opening 8*b* in a direction of arrow X1.

The operation hole 9 is formed through an outer wall 13 of the main body 8 of the connector housing 4. The operation hole 9 has a rectangular shape when viewed from the top. Part of an outer face 14*a* of a main body 14 (described later) of the inner holder 5 faces the operation hole when the inner holder 5 is mounted in the connector housing 4.

A longitudinal direction of the operation hole 9 is parallel to the direction of arrow X1. An operated member 15 (described later) is located within the operation hole 9. The operated member 15 can be pushed in the direction of arrow X1 and a direction of arrow X2 from the outside of the connector housing, using a jig 16 or the like, so that the inner holder 5 is moved in directions of arrows X. The direction of arrow X2 is a direction of insertion of the inner holder 5 into the connector housing 4, and is parallel and opposite to the direction of arrow X1.

Figure 7:
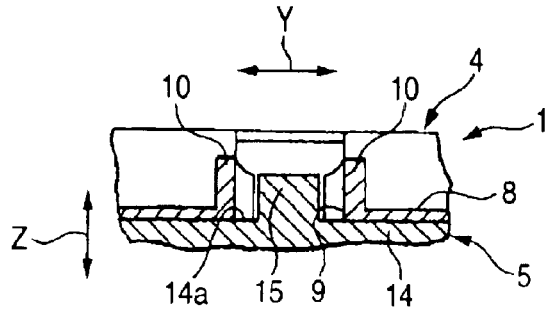
FIG. 7 is an enlarged section view taken along the line VII—VII of FIG. 1.

The protective walls 10 extend upright (perpendicularly) from the outer wall 13 of the main body 8 of the connector housing 4. The protective walls 10 are formed at a peripheral edge portion of the operation hole 9. The operated member 15 is located between the pair of protective walls 10 as shown in FIG. 7. The pair of protective walls 10 are spaced from each other in directions of arrows Y (that is, the direction of the width of the connector housing 4, inner holder 5 and male terminals 3) which is perpendicular to the directions of arrows X.

The protective walls 10 extend in the directions of arrows X and projected from the outer wall 13 of the main body 8 of the connector housing 4 beyond the operated member 15 in directions of arrows Z (that is, the direction of the thickness of the connector housing 4, inner holder 5 and male terminal 3).

Figure 2:
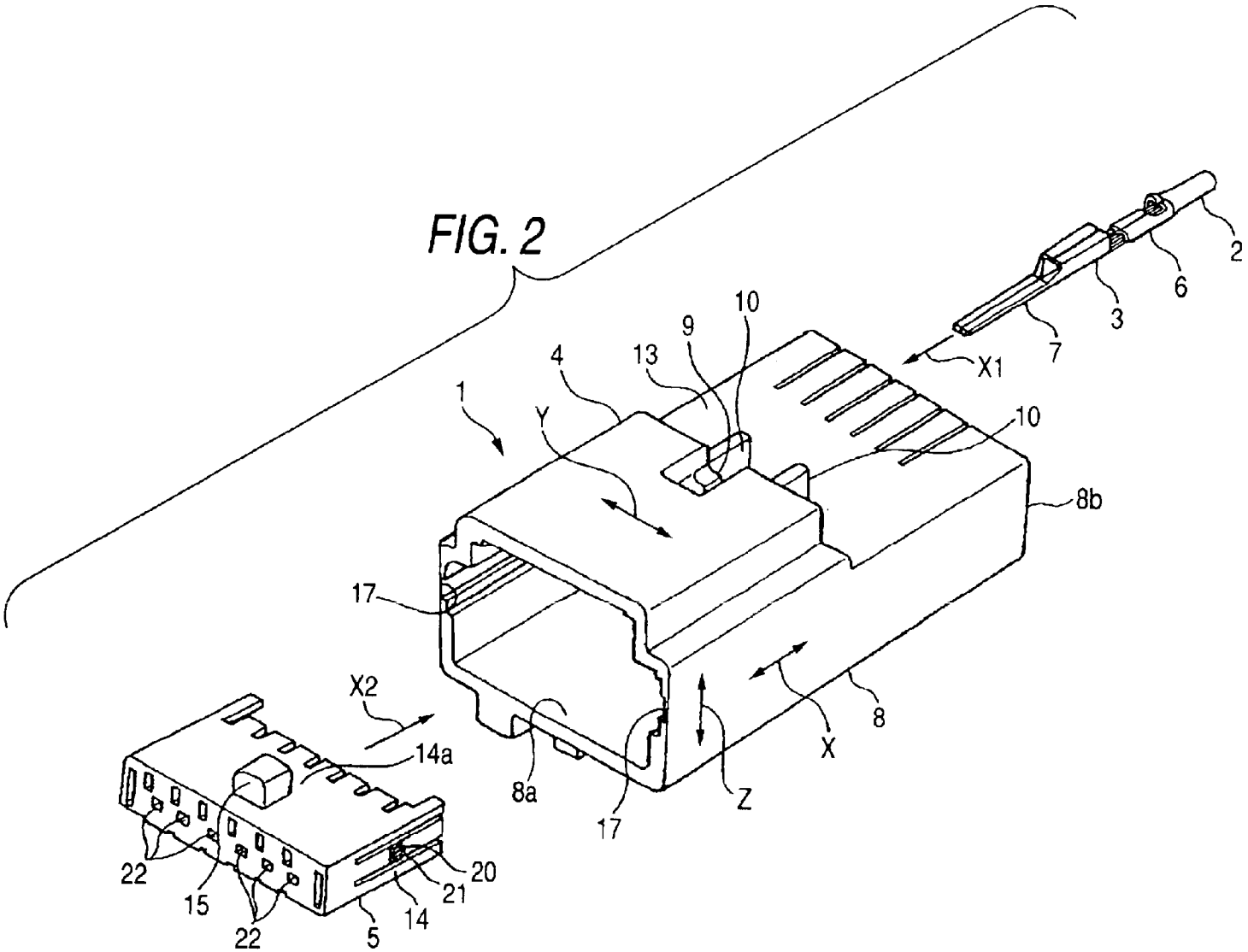
FIG. 2 is an exploded, perspective view of the connector of FIG. 1.

As shown in FIG. 2, the inner holder 5 comprises: the box-shaped main body 14; a pair of first projections 20 (only one of which is shown in FIG. 2), and a pair of second projections 21 (only one of which is shown in FIG. 2), which are formed respectively on the opposite side edges (side faces) of the main body 14 spaced from each other in the direction of arrow Y; and the operated member 15. These members 15, 20 and 21 are formed integrally on the main body 14. The first projection 20 and the second projection 21, formed on each of the opposite side edges of the main body 14, are juxtaposed to each other in the directions of arrows Z.

As shown in FIG. 2, a pair of slide grooves 17 are formed in a pair of opposed inner faces of the main body 8 of the connector housing 4 facing each other in the directions of arrows Y and extending linearly in the directions of arrows X.

The opposite side edges (relative to the directions of arrows Y) of the inner holder 5 are received respectively in the slide grooves 17, so that the inner holder 5 is supported by these slide groove portions 17 slidably in the directions of arrows X, so that the inner holder 5 can be moved between a provisional engagement position and a plenary engagement position.

As shown in FIGS. 8A through 8D, a first stopper projection 18 and a second stopper projection 19 are projected from a longitudinal center portion of each slide groove 17. The first stopper projection 18 is disposed closer to the first opening 8*a* than the second stopper projection 19 is. The first stopper projection 18 is opposed to an associated one of the first projections 20 formed on the inner holder 5 in the directions of arrows X.

The second stopper projection 19 is disposed closer to the second opening 8*b* than the first stopper projection 18 is. The second stopper projection 19 is opposed to an associated one of the second projection 21 formed on the inner holder 5, in the directions of arrows X.

Figure 3:
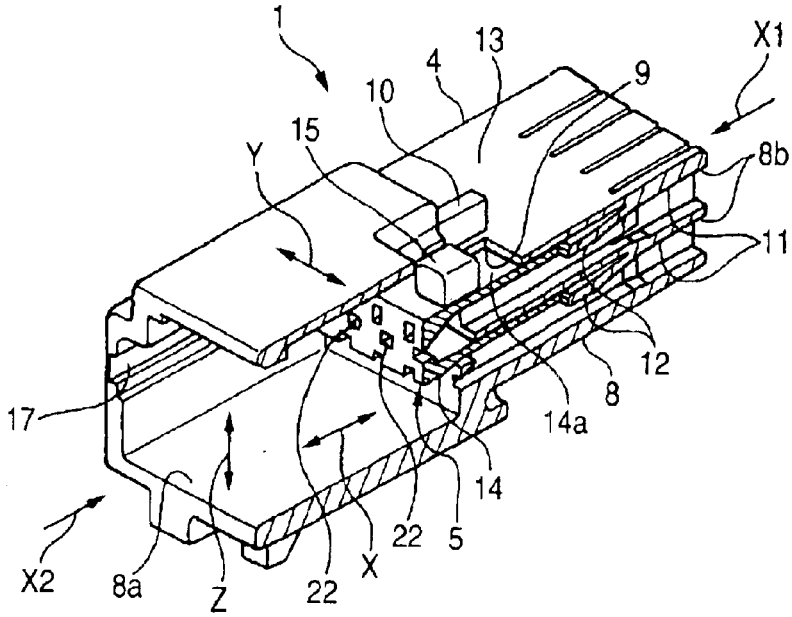
FIG. 3 is a sectional perspective view of the connector of FIG. 1, showing a state that an inner holder is located in a provisional engagement position.
Figure 5:
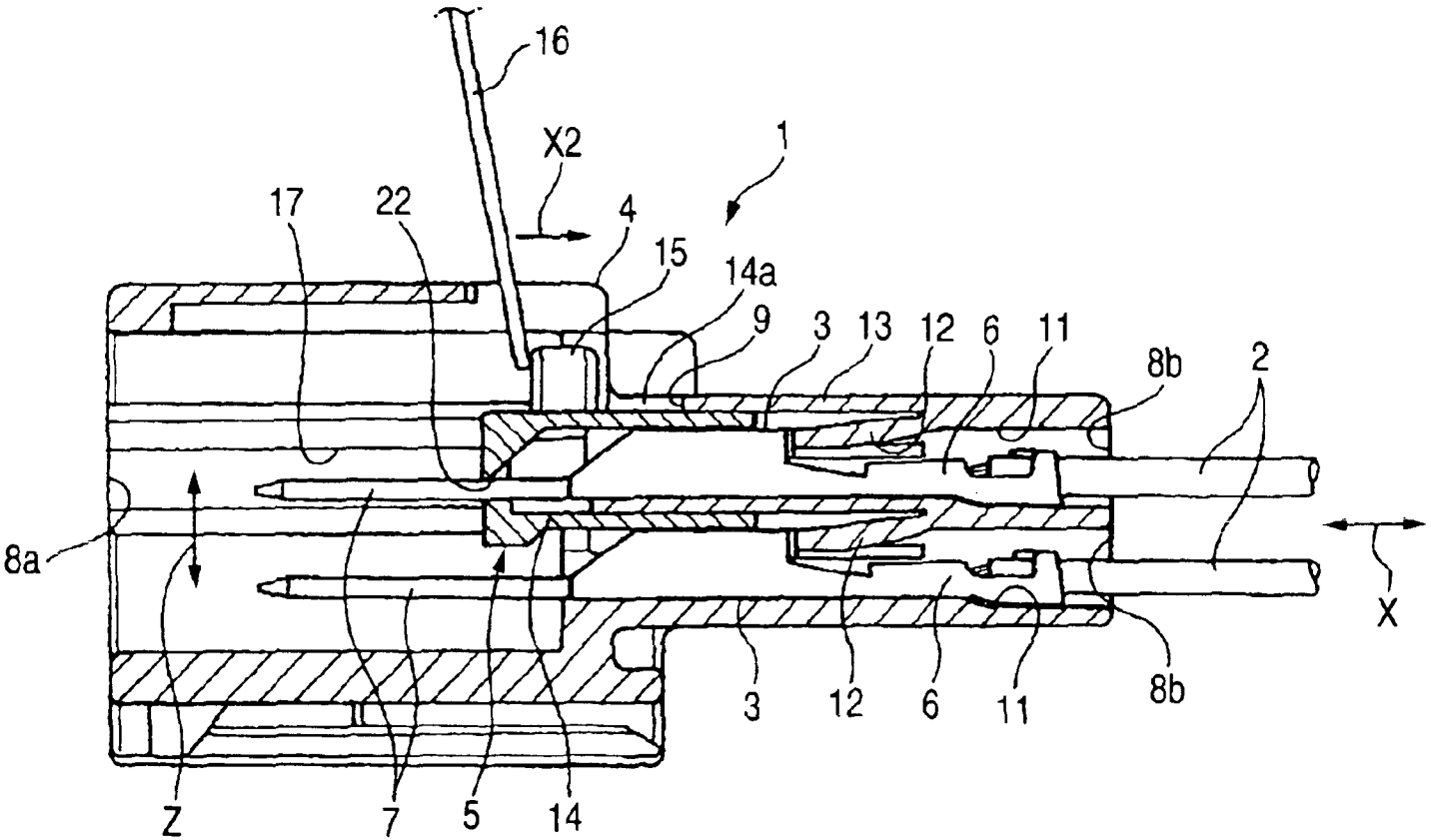
FIG. 5 is a sectional side view of the connector of FIG. 1, showing a state that the inner holder is located in the provisional engagement position.

In the provisional engagement position, the main body 14 of the inner holder 5 is spaced from the retaining pawls 12 in the directions of arrows X as shown in FIGS. 3 and 5. Incidentally, the main body 14 of the inner holder 5 allows the elastic deformation of the retaining pawls 12 so as to allow the insertion of the male terminals 3 into the respective terminal chambers 11 through second opening 8*b*, and also to allow the male terminals 3 in the respective terminal chambers 11 to be withdrawn from the main body 8 of the connector housing 4 through second opening 8*b*.

Figure 4:
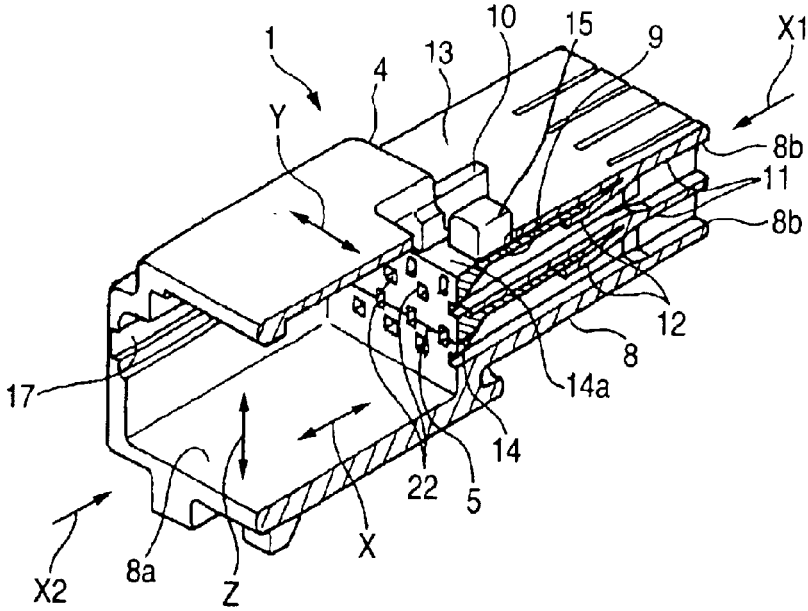
FIG. 4 is a sectional perspective view of the connector of FIG. 1, showing a state that the inner holder is located in a plenary engagement position.
Figure 6:
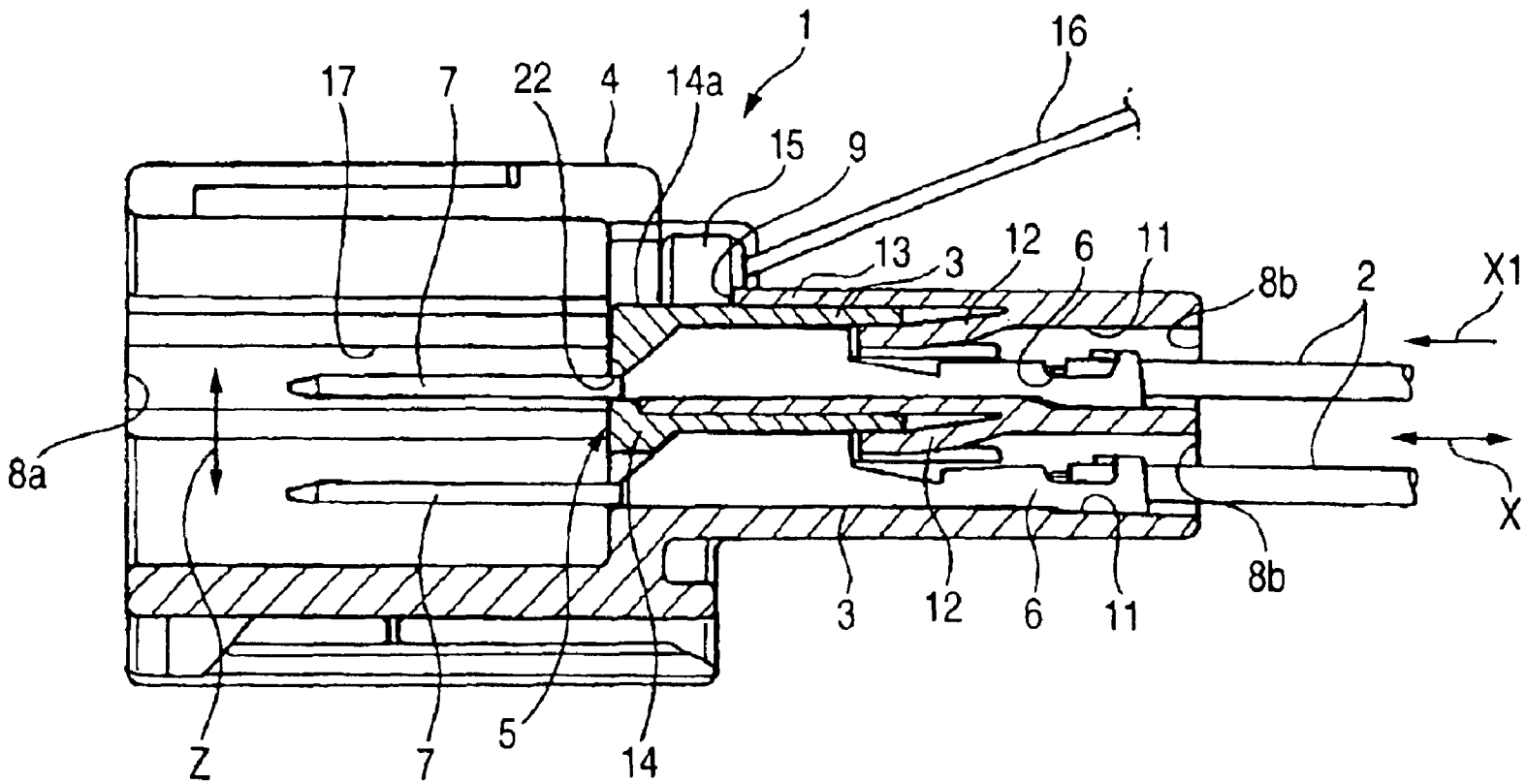
FIG. 6 is a sectional side view of the connector of FIG. 1, showing a state that the inner holder is located in the plenary engagement position.

In the plenary engagement position, the main body 14 of the inner holder 5 overlaps the retaining pawls 12 in the directions of arrows Z as shown in FIGS. 4 and 6. Incidentally, the main body 14 of the inner holder 5 prevents the elastic deformation of the retaining pawls 12 so as to prevent the male terminals 3 in the respective terminal chambers 11 from being withdrawn from the main body 8 of the connector housing 4 through second opening 8*b*.

A plurality of positioning holes 22 are formed through a wall of the main body 14 of the inner holder 5 as shown in FIGS. 5 and 6. Particularly in the plenary engagement position, the electrical contact portions 7 of the male terminals 3 respectively pass through the positioning holes 22 so as to project toward the first opening 8*a*. The main body 14 of the inner holder 5 is mounted in the connector housing 4, and the electrical contact portions 7 of the male terminals 3 pass respectively through the positioning holes 22, so that the inner holder 5 positions the electrical contact portions 7 of the male terminals 3 relative to the connector housing 4.

The operated member 15 extends from the outer face 14*a* of the main body 14, and projects outwardly from the connector housing 4. When the main body 14 is mounted in the main body 8 of the connector housing 4, the operated member 15 is located in the operation hole 9. Incidentally, the operated member 15 projects outwardly from the outer face of the main body 8 of the connector housing 4. Accordingly, the operated member 15 can be operated from the outside of the connector housing 4.

When the main body 14 is located in the provisional engagement position, the operated member 15 is located at an end edge of the operation hole 9 disposed close to the first opening 8*a*. When the main body 14 is located in the plenary engagement position, the operated member 15 is located at an end edge of the operation hole 9 disposed close to second opening 8*b*.

Figure 8A:
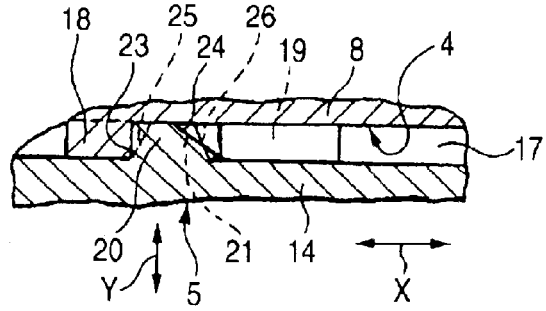
FIG. 8A is a section view showing the position of a first projection of the inner holder when the inner holder is located in the provisional engagement position.

As shown in FIG. 8A, an end face 23 (shown in FIG. 8) of each first projection 20, disposed close to the first opening 8*a*, is perpendicular to the directions of arrows X, and is parallel to the directions of arrows Y and Z. An end face 24 (shown in FIG. 8) of the first projection 20, disposed close to second opening 8*b*, is slanting inwardly (that is, toward the main body 14 of the inner holder 5) gradually toward second opening 8*b*.

Figure 8B:
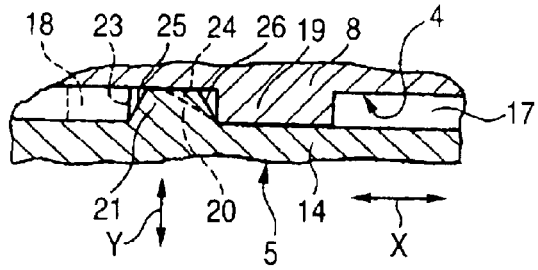
FIG. 8B is a section view showing the position of a second projection of the inner holder when the inner holder is located in the provisional engagement position.

As shown in FIG. 8B, an end face 25 of each second projection 21, disposed close to the first opening 8*a*, is slanting outwardly (that is, away from the main body 14 of the inner holder 5) gradually toward second opening 8*b*. An end face 26 (shown in FIG. 8) of the second projection 21, disposed close to second opening 8*b*, is slanting inwardly (that is, toward the main body 14 of the inner holder 5) gradually toward second opening 8*b*.

In the connector 1, the male terminals 3 are inserted respectively into the terminal chambers 11 through the second opening 8*b* in the direction of arrow X1. As a result, the retaining pawls 12 retain the male terminals 3, respectively, as shown in FIG. 5. Then, the inner holder 5 is inserted into the main body 8 of the connector housing 4 through the first opening 8*a* in the direction of arrow X2. The first projections 20 on the inner holder 5, as well as the switching projections 21, are inserted respectively into the slide grooves 17 formed in the connector housing 4.

At this time, the end face 24 of each first projection 20 is brought into contact with the associated first stopper projection 18, and then the main body 8 of the connector housing 4 is elastically deformed outward, and then the end face 23 of the first projection 20 is held in intimate contact with the first stopper projection 18 as shown in FIG. 8A. Thus, the inner holder 5 is mounted in the connector housing 4 in such a manner that this inner holder 5 is retained on the inner face of the connector housing 4.

The operated member 15 is located at that end edge of the operation hole 9 disposed close to the first opening 8*a*. Thus, the inner holder 5 is located in the provisional engagement position as shown in FIGS. 3 and 5.

Since the end face 23 of each first projection 20 of the inner holder 5 is parallel to the directions of arrows Y and Z, the inner holder 5 is prevented from being disengaged from the connector housing 4. Thus, the first projections 20 are retainingly engaged with the inner face of the connector housing 4 to prevent the inner holder 5 from being disengaged from the connector housing 4.

In the provisional engagement position, the end face 26 of each second projection 21 faces the associated second stopper projection 19 in the directions of arrows X as shown in FIG. 8A. Then, the operated member 15 is pushed in the direction of arrow X2 by the jig 16 as shown in FIG. 5. Accordingly, the end face 26 of each second projection 21 is brought into contact with the second stopper projection 19 as shown in FIG. 8B so as to deform the connector housing 4 outward.

Figure 8C:
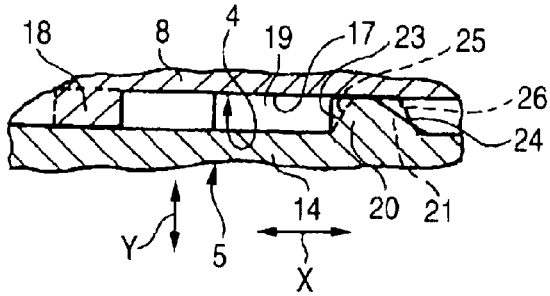
FIG. 8C is a section view showing the position of the first projection of the inner holder when the inner holder is located in the plenary engagement position.
Figure 8D:
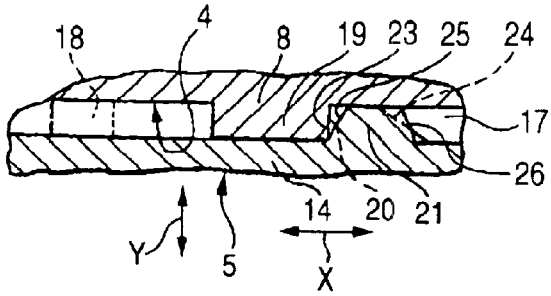
FIG. 8D is a section view showing the position of the second projection of the inner holder when the inner holder is located in the plenary engagement position.
Figure 9A:
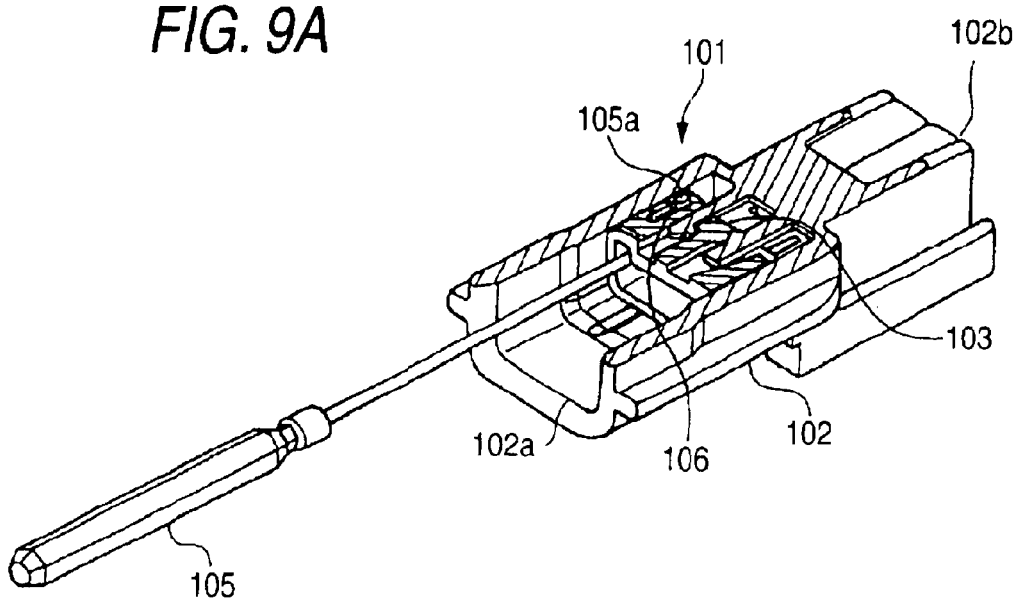
FIGS. 9A and 9B are sectional perspective views showing a first related-art connector.
Figure 9B:
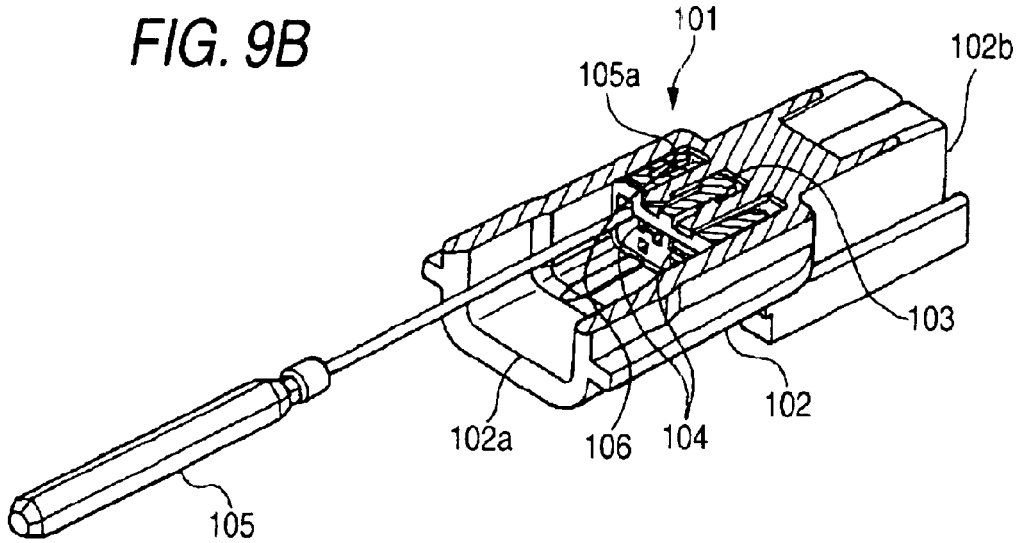
Figure 10A:
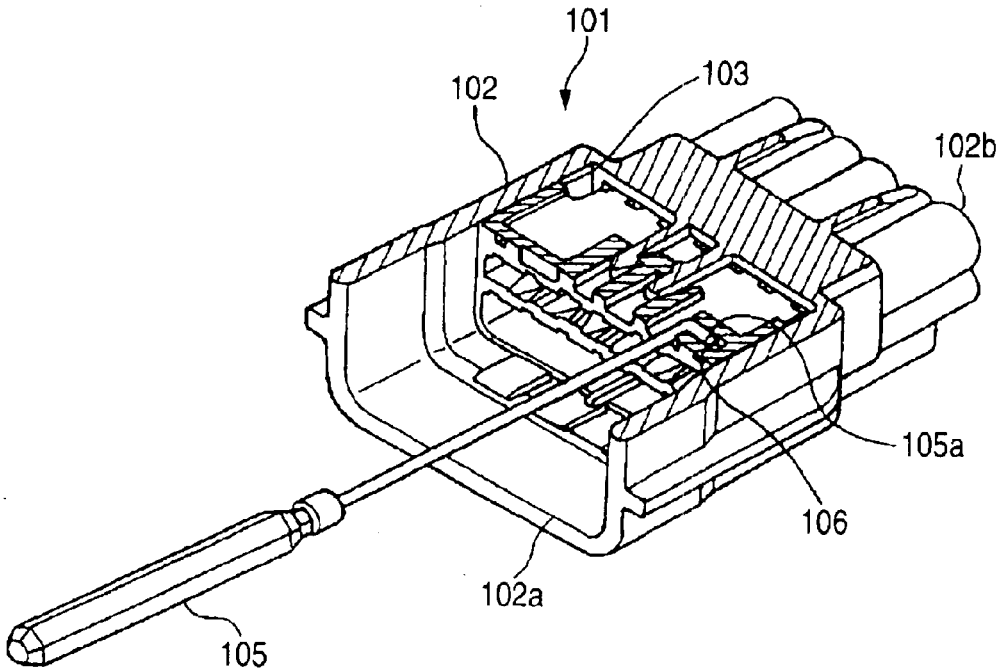
FIGS. 10A and 10B are sectional perspective views showing a second related-art connector.
Figure 10B:
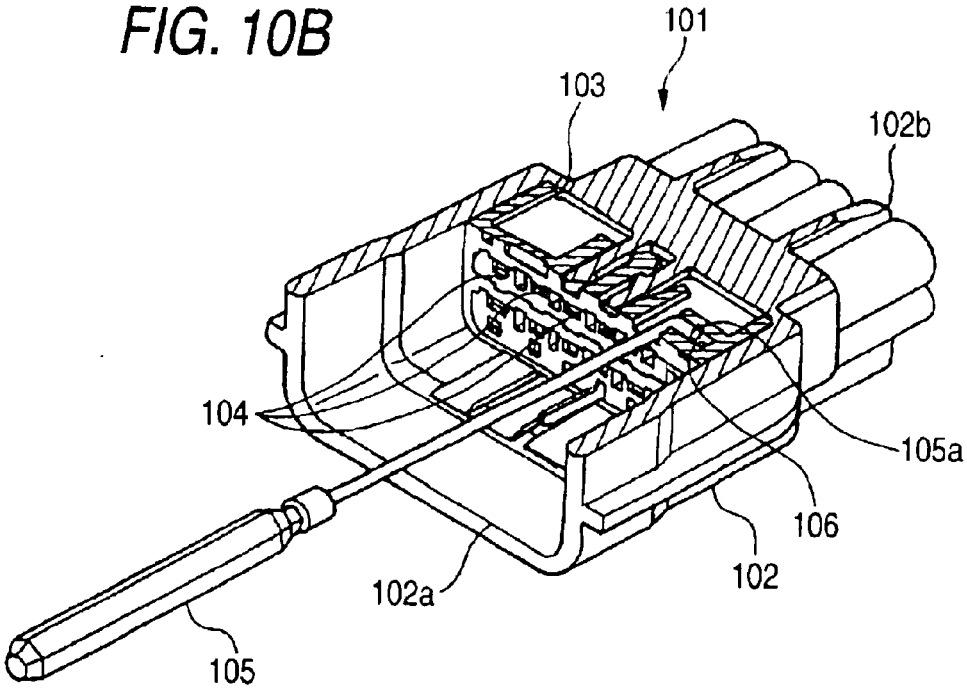
Figure 11A:
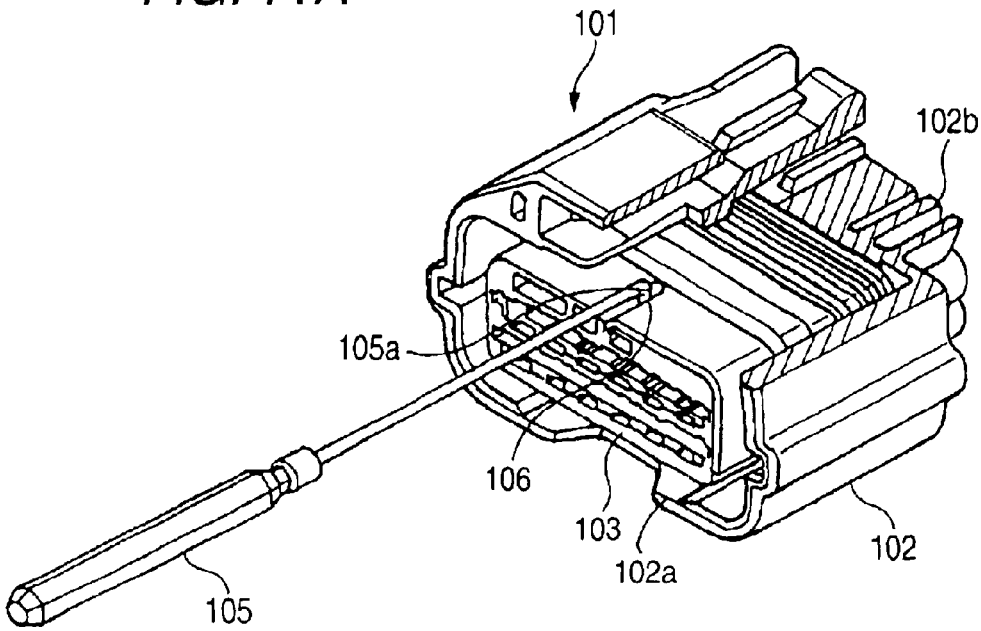
FIGS. 11A and 11B are sectional perspective views of a third related-art connector.
Figure 11B:
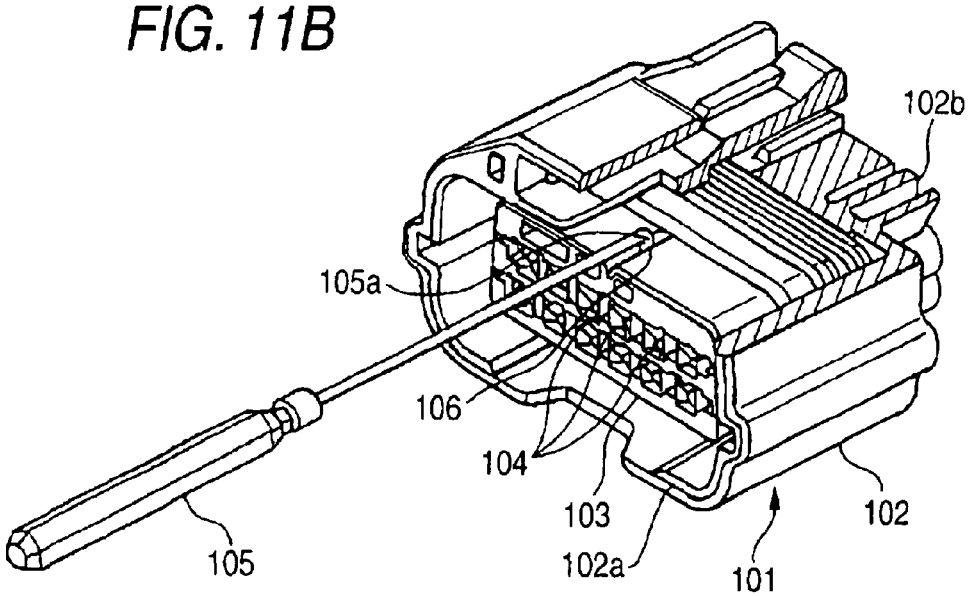

As a result, the operated member 15 is located at that end edge of the operation hole 9 disposed close to second opening 8*b*, so that the inner holder 5 is located in the plenary engagement position as shown in FIGS. 4 and 6. In the plenary engagement position, the end face 23 of each first projection 20 is brought into contact with the associated second stopper projection 19 as shown in FIG. 8C, and the end face 25 of each second projection 21 faces the associated second stopper projection 19 in the directions of arrows X as shown in FIG. 8D.

The operated member 15, located at the end edge of the operation hole 9 disposed close to second opening 8*b*, is pushed in the direction of arrow X1 by the jig 16 as shown in FIG. 6. Accordingly, the end face 25 of each second projection 21 is brought into contact with the second stopper projection 19 so as to deform the connector housing 4 outward. As a result, the inner holder 5 is slid from the plenary engagement position to the provisional engagement position.

As described the above, the second projections 21 are retainingly engaged with the inner face of the connector housing 4 to locate the inner holder 5 in either of the provisional engagement position and the plenary engagement position, and also to allow the inner holder 5 to be displaced between the provisional engagement position and the plenary engagement position.

In this embodiment, by pushing the operated member 15 projected through the operation hole 9 formed in the outer wall 13 of the connector housing 4, the inner holder 5 can be moved between the provisional engagement position and the plenary engagement position. Since the operation hole 9 faces a part of the outer face 14*a* of the inner holder 5, it is possible to prevent the jig 16 from being brought into contact with the electrical contact portion 7 of the male terminal 3 accidentally. Therefore, the electrical contact portion 7 of the male terminal 3 is prevented from being bent and damaged, and the male terminal 3 can be positively connected to the female terminal.

Since the operated member 15 is projected from the main body 14 of the inner holder 5 and located within the operation hole 9, the operated member 15 can be positively operated. Therefore, the inner holder 5 can be positively moved between the provisional engagement position and the plenary engagement position.

Since the operated member 15 is located between the two protective walls 10, the protective walls 10 will not prevent the movement of the operated member 15. In addition, the protective walls 10 are extend from the outer wall 13 of the connector housing 4 so as to project beyond the operated member 15, an external article or the like is prevented from being inadvertently brought into contact with the operated member 15. Therefore, the inner holder 5 is prevented from being accidentally moved particularly to the provisional engagement position, and therefore is prevented from being accidentally disengaged from the connector housing 4.

Since the first projection 20 and second projection 21, formed on each of the opposite side edges of the inner holder 5, are juxtaposed to each other in the directions of arrows Z, a mold for molding the inner holder 5 can be formed into a simple structure. Therefore, the cost of the inner holder 5 and hence the cost of the connector 1 can be prevented from being increased.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector, comprising:

a tubular connector housing, adapted to receive a terminal fitting coupled with an electric wire; and an inner holder, accommodated in the connector housing so as to place the terminal fitting therein, the inner holder being slidable between a first position which allows the terminal fitting to be withdrawn from the connector housing and a second position which prevents the terminal fitting from being withdrawn from the connector housing;

wherein a through hole is formed in a side wall of the connector housing such that a part of an outer side face of the inner holder is actuated therethrough, in order to displace the inner holder between the first position and the second position: and a pair of protective walls are formed on the side wall of the connector housing at both sides of the through hole relative to a direction perpendicular to the sliding direction of the inner holder.

2. The connector as set forth in claim 1, wherein an operated member, which is to be externally actuated in the sliding direction of the inner holder, is formed on the outer side face of the inner holder so as to be located within the through hole.

3. The connector as set forth in claim 2, wherein the operated member is a projection extending outward through the through hole.

4. The connector as set forth in claim 3, wherein:

a top face of each of the protective walls is situated upper than a top face of the operated member.

5. The connector as set forth in claim 1, wherein:

at least one pair of projections are formed on the outer face of the inner housing, and are arranged to be engaged with an inner face of the connector housing such that the inner holder is retained in either the first position or the second position while being allowed to be displaced between the first position and the second position; and the pair of projections are juxtaposed in a direction orthogonal to the sliding direction of the inner holder.

* * * * *